US005413079A

United States Patent [19]

Laufer

[11] Patent Number: 5,413,079

[45] Date of Patent: May 9, 1995

[54] FUEL INJECTION PUMP

[75] Inventor: Helmut Laufer, Gerlingen, Germany

[73] Assignee: Robert Bosch GmbH, Stuttgart, Germany

[21] Appl. No.: 201,956

[22] Filed: Feb. 25, 1994

[30] Foreign Application Priority Data

May 12, 1993 [DE] Germany ..... 43 15 776.9

[51] Int. Cl.[6] ..... F02M 37/04

[52] U.S. Cl. ..... 123/502; 123/179.17

[58] Field of Search ..... 123/502, 449, 179.17, 123/503

[56] References Cited

U.S. PATENT DOCUMENTS

| | | | |
|---|---|---|---|
| 2,910,975 | 11/1959 | Evans | 123/502 |
| 3,147,746 | 9/1964 | Hofer | 123/502 |
| 3,486,492 | 12/1969 | Lehnerer | 123/502 |
| 4,355,621 | 10/1982 | Yasuhara | 123/501 |
| 4,368,709 | 1/1983 | Yasuhara | 123/502 |
| 4,493,302 | 1/1985 | Kawamura | 123/502 |

FOREIGN PATENT DOCUMENTS 822194 10/1959 United Kingdom .

*Primary Examiner*—Carl S. Miller

*Attorney, Agent, or Firm*—Edwin E. Greigg; Ronald E. Greigg

[57] ABSTRACT

A fuel injection pump in which the injection onset is varied by means of an injection adjuster, which has a two part adjusting piston acted upon by a hydraulic control pressure, which piston is adjustable counter to a restoring spring and by means of a bolt, engages the cam drive of the fuel injection pump in order to adjust the injection onset. To reduce the highest pressure in the high-pressure chamber of the fuel injection pump and to form the course of injection pressure, the adjusting piston is embodied in two parts, with a first piston that is adjustable relative to the second piston counter to a compression spring and the second piston is connected with the bolt. This makes possible a deflection motion of the piston relative to the second piston and a reduction in the pump piston stroke speed.

9 Claims, 1 Drawing Sheet

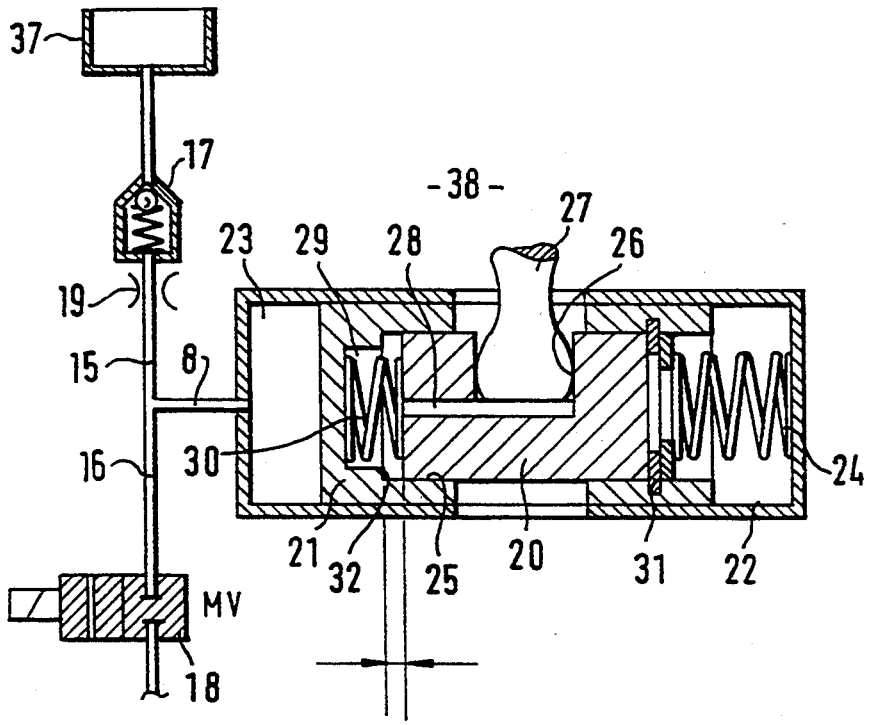
37
17
-38-
27
23
29
28
26
19
15
8
30
24
16
21
32
25
20
31
22
MV
18

FUEL INJECTION PUMP

BACKGROUND OF THE INVENTION

The invention is based on a fuel injection pump as defined hereinafter. A fuel injection pump of this kind is already known from German Patent Application 29 23 445 A.

In fuel injection pumps, the following problem arises: If the pumping rate of the fuel injection pump is optimized to the rated output point of the internal combustion engine at maximum load and maximum rpm, so that the maximum allowable pressure in the pump work chamber of the fuel injection pump occurs, then this pressure is as a rule overly low, given a low rpm of the fuel injection pump or of the associated engine, at the lower full-load point, for the sake of the quality of fuel introduction into the engine combustion chambers through injection valves. If the pumping rate is raised in this range, then although the pressure at this lower full-load point then desirably rises, nevertheless, at the rated power point the fuel injection pump is overloaded. Accordingly, if the pressure at the lower full-load point is raised, then provision must be made so that the pump will not be overloaded at the rated power point.

The aforementioned known fuel injection pump discloses a device with which the pumping rate is reduced in the lower load/rpm range as a function of the feeding in full-load operation and at high rpm, in order to achieve noise-abating long injection times or low injection rates with respect to the injection quantity. Then the work chamber upstream of the adjusting piston is supplied continuously with pressure fluid, brought to an rpm-dependent pressure, from a pressure fluid source for the sake of rpm-dependent adjustment of the adjusting piston and hence of the onset of high-pressure pumping by the pump piston, and the withdrawal device is put into operative connection with the work chamber upstream of the adjusting piston as a function of the rpm.

OBJECT AND SUMMARY OF THE INVENTION

The fuel injection pump according to the invention has the advantage over the prior art that the pressure in the work chamber in the low rpm/load range attains a desired high injection pressure, without the fuel injection pump being overloaded by overly high pressures in the high rpm/load range of the pump.

An advantageous embodiment of the invention is the embodiment of the fuel injection pump in which in a simple way, beyond a predetermined load/rpm point, the pumping rate of the pumping piston is reduced over a predetermined rotary angle range. The result is a shaping of the course of the injection pressure that is controlled by the pressure in the pump work chamber, or by the pressure generated by it in the work chamber upstream of the adjusting piston. The control of the injection rate or of the pressure in the pump work chamber for an operating range sought is oriented to the pump work chamber pressure required for injection.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing shows an exemplary embodiment of the invention.

DESCRIPTION OF THE PREFERRED EMBODIMENT

The drawing shows a cylinder 22, in which a two-piece adjusting piston is adjustable counter to the force of a spring 24. The adjusting piston comprises a first piston 20, which has a lateral recess 26 that is engaged by a free end of a bolt 27 that adjusts the cam drive of an injection adjuster, not shown, and a second piston 21, which has an axial blind bore 25 in which the first piston 20 is displaceably supported. The axial blind bore 25 has a lateral through opening for the bolt 27. A work chamber 23 facing opposite the spring 24 and enclosed in the cylinder 22 by the second piston 21 communicates with a line 8 which is adjoined by a pressure fluid supply line 15. Disposed in the pressure fluid supply line 15 are a throttle 19 and a check valve 17 that opens in the direction of the work chamber 23. The pressure fluid supply line branches off from a pressure source 37, carrying pressure fluid at elevated pressure, that is disposed in the interior of a fuel injection pump having the injection adjuster, and in it at the same time forms the suction chamber from which the high-pressure portion of the fuel injection pump is supplied with fuel. Also branching off from the line 8 is a pressure fluid outflow line 16, which leads to a relief chamber and contains an electrically controlled valve, in this case, a magnet valve 18.

On its face end oriented toward the work chamber 23, the first piston 20 that is displaceable in the axial blind bore 25 there encloses a work chamber 29, in which a compression spring 30 is disposed; this spring is supported by the face end of the axial blind bore and urges the first piston 20 to a stop 31 that is provided inside the axial blind bore 25 and limits the relative adjustment of the first piston 20 with respect to the second piston 21. The work chamber 29 communicates via an axial conduit 28 with the recess 26 and via this recess with a chamber 38, which is acted upon by a pressure fluid that is at a low pressure of approximately 0.5 to 1 bar. This pressure fluid may preferably be fuel. Via this axial conduit 28, the work chamber is supplied with pressure fluid and can also be relieved. The chamber in the cylinder 22 that receives the spring 24 is conversely entirely pressure-relieved. Thus the first piston is urged by pressure fluid toward the stop 31, in a reinforcement of the action of the spring 30.

The adjusting pistons 20 and 21 in this case is the piston, known in fuel injection pumps, of an injection onset adjuster. Depending on the displacement of the adjusting piston, the bolt 27, like the corresponding bolt in a fuel injection pump known from German Patent Application 21 58 689 A, adjusts a roller ring, not shown in this application, which is supported rotatably but in a stationary fashion except for the rotation by the bolt 27 in the housing of the fuel injection pump, and on whose rollers a cam disk rolls with its cams. The cam disk is coupled on the one hand to a drive shaft of the fuel injection pump and on the other to a pump piston, which because of the rotation of the drive shaft together with the cam disk executes a rotating motion and thus serves as a distributor, and at the same time, because of the cam disk rolling on the rollers, executes a reciprocating motion and thus, as a pump piston, executes intake and pumping strokes. As is generally known but not further shown here, the pump piston encloses a pump work chamber, which upon the intake stroke is filled with fuel from a suction chamber, which here at the same time forms the pressure fluid source 37, that is filled with fuel and is disposed in the interior of the fuel injection pump, and in the pumping stroke pumps fuel at high pressure to one injection valve at a time of the engine. The high-pressure pumping of fuel to the injection valves is determined essentially by the onset of the reciprocating motion of the cam disk along with the pump piston as the cam disk travels over the rollers of the roller ring, and the end of pumping for determining the fuel injection quantity is determined essentially by opening of a relief conduit. The cam disk is kept in contact with the roller ring by a restoring force in the form of restoring springs. This restoring force is also reinforced by the reaction force of the pump piston in its pumping stroke. In the process, via the side of the cams of the cam disks, the roller ring experiences a force in its circumferential direction, and this force is counteracted by the adjusting force of the adjusting piston. As a result of this force exerted from the direction of the pump piston, however, the work chamber 23 undergoes a pressure increase compared with the pressure level previously set in order to adjust the adjusting piston. The degree of this pressure elevation corresponds to the pressure generated in the pump work chamber. The pressure elevation is on the other hand possible only because the check valve 17, which closes toward the pressure fluid source, encloses the pressure fluid volume delivered to the work chamber while the magnet valve is simultaneously closed.

If it is employed with a different type of fuel injection pump, that is, the distributor type, as known from European Patent Application 0 039 304, then the adjusting piston is coupled via the bolt 27 to a cam ring that is rotatably supported in the injection pump housing; this cam ring has a cam race pointing inward, on which, upon a rotation of the distributor, traveling coaxially with the cam ring, of the fuel injection pump pistons supported in this distributor travel and in the process execute a pumping inward and outward motion, corresponding to the course of the cams of the cam race. The pump pistons then enclose a pump work chamber, from which fuel at injection pressure is pumped by the distributor to one injection line and one injection valve each, triggered by the distributor. Once again, the pump pistons in their high-pressure pumping stroke exert a force that via the rising of the cams of the cam race forces a restoring force upon the cam ring in the high-pressure pumping stroke, in such a way that the two-piece adjusting piston 20, 21 is acted upon by this reaction force in the direction of the work chamber 23, and the work chamber 23 experiences an elevation of pressure as described above.

The mode of operation of the apparatus as described thus far is as follows: the load on the first piston 20 from the spring 30 causes this piston to rest firmly on the second piston 21, so that the two initially can be considered a rigid unit, and the location of the second piston 21 also determines the location of the bolt 27 and thus the setting of the injection onset. During the intake strokes of the pump piston or pistons, in which no additional force acts upon the two-piece adjusting piston 20, 21, which in a reinforcement of the spring 24 would displace the adjusting piston and positively displace pressure fluid out of the work chamber 23, fuel is delivered via the check valve 17 and the throttle from the suction chamber 37, via the pressure fluid supply line 15, to the work chamber. The pressure in the work chamber 23 can assume the level of the pressure in the pressure fluid source, as long as the magnet valve 18 is closed. By actuation of this valve 18, regardless of the pressure of the suction chamber 37, the pressure in the work chamber 23 can be varied, with the throttle 19 at the check valve 17 acting as a decoupling throttle. This change is carried in each case during the intake stroke by suitable triggering of the magnet valve 18, so that upon the onset of the ensuing pumping stroke of the pump piston or pistons, the pressure in the work chamber 23 via the adjustment of the adjusting piston establishes the correct onset of the high-pressure pumping stroke of the pump piston. With the onset of high-pressure pumping, the magnet valve 18 remains closed.

Upon the elevation in the restoring force upon the adjusting piston that now takes place, the first piston 20 can be displaced relative to the second piston 21 once the prestressing of the compression spring 30 is overcome, so that the cam lobe curve likewise shifts away from the resultant injection onset adjustment or roller ring adjustment. The stroke speed of the pump piston and hence its pumping rate are thus reduced. In turn, this means that the pressure rise rate or the pressure attained in the pump work chamber becomes less, taking into account the simultaneously occurring injection and withdrawal of fuel from the pump work chamber to the injection location.

Depending on the embodiment of the compression spring 30 and on its initial tension in the spring constant, a certain pressure course can thus be shaped in adapted fashion during the high-pressure pumping stroke of the pump piston. At the same time, the essential advantage is attained that even a maximal pressure in the pump work chamber is not exceeded, particularly with adaptation to the rated power point of the fuel injection pump or of the engine.

A modification of the pressure course embodiment can be achieved by providing that the first piston 20 can be displaced relative to the second piston 21 only by a predetermined amount. To that end, a stop 32 is provided in the axial blind bore 25, against which stop the first piston comes to rest after the predetermined deflection travel. With further elevation of the impingement of force upon the adjusting piston of the injection adjuster via the bolt 27, both pistons 20 and 21 then form a unit and can at most be adjusted to the extent of the compressibility of the fluid in the work chamber 23.

At the end of the high-pressure pumping stroke, in the course of the ensuing intake stroke, the first piston 20 is returned to its stop 31 again, and the work chamber 29 is refilled with fuel via the conduit 28.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United State is:

1. A fuel injection pump for internal combustion engines, having at least one pump piston driven by a cam drive, which piston defines a pump work chamber in a pump work cylinder, from said pump work chamber fuel is pumped at high pressure to a fuel injection valve in the pumping stroke of the pump piston, wherein the cam drive has a substantially stationary part and one moving part driven by a drive shaft of the injection pump, of which parts one is provided by a cam race and of which the moving part exerts a repelling force via the cam race upon the essentially stationary part, and an adjusting piston (20, 21), which in a cylinder (22) encloses a work chamber (23), which is supplied with pressure fluid from a pressure fluid source (37) and by the pressure fluid, counter to a restoring force (24), is adjustably coupled to the substantially stationary part of the cam drive, wherein the repelling force is in the same direction as the restoring force and with its adjustment adjusts the onset of the high-pressure pumping stroke of the pump piston with respect to a rotary position of the drive shaft, and the pressure fluid pressure in the work chamber (23) is controlled in order to vary the pumping stroke onset as a function of engine operating parameters, the adjusting piston is embodied in two parts, with a first piston (20) coupled to the moving part and displaceably guided in a blind bore (25) of a second piston (21), wherein the second piston (21), with one end face, defines the work chamber (23) in the cylinder (22), said work chamber (23) is supplied fluid whose pressure is controlled by a pressure control device, said second piston delimited by its other end forms a relieved space with the cylinder, a compression spring (24) acting upon said other end of said second piston being arranged in said relieved space and supported in stationary fashion, and the first piston (20) with its one face end, oriented toward the closed end of the blind bore (25), encloses a second work chamber (29), in which a compression spring (30) is disposed that acts upon the face end of the piston (20), by said second spring, this piston can be made to contact a stop (31) on the second piston (21), and said work chamber (29) is permanently connected to a chamber (29) which is permanently connected to a chamber (38) under a low pressure, which pressure is higher than the pressure in said relived space.

2. A fuel injection pump as defined by claim 1, in which the work chamber communicates with the pressure fluid source via a check valve that opens toward the work chamber.

3. A fuel injection pump as defined by claim 2, in which the work chamber (23) communicates with a pressure fluid supply line (15) leading from the pressure fluid source (37) and with a pressure fluid outflow line (16), having an electrically controlled valve (18) leading to a relief chamber, wherein the pressure in the work chamber (23) is controlled by the electrically controlled relief valve in order to vary the onset of the pumping stroke at a given time in such a manner that this pressure is established in each case before the pumping onset of each pump piston pumping stroke.

4. A fuel injection pump as defined by claim 1, in which the compression spring (30) in the work chamber (29) moves the first piston to a stop (31) in a prestressed fashion.

5. A fuel injection pump as defined by claim 2, in which the compression spring (30) in the work chamber (29) moves the first piston to a stop (31) in a prestressed fashion.

6. A fuel injection pump as defined by claim 3, in which the compression spring (30) in the work chamber (29) moves the first piston to a stop (31) in a prestressed fashion.

7. A fuel injection pump as defined by claim 4, in which the first piston (20) is adjustable counter to the compression spring (30) by a predetermined distance until said first piston contacts a stop (32) on the second piston (21).

8. A fuel injection pump as defined by claim 5, in which the first piston (20) is adjustable counter to the compression spring (30) by a predetermined distance until said first piston contacts a stop (32) on the second piston (21).

9. A fuel injection pump as defined by claim 6, in which the first piston (20) is adjustable counter to the compression spring (30) by a predetermined distance until said first piston contacts a stop (32) on the second piston (21).

* * * * *